US005220719A

United States Patent [19]

You

[11] Patent Number: 5,220,719

[45] Date of Patent: Jun. 22, 1993

[54] METHOD OF MAKING GAME RACKET FRAME

[76] Inventor: Chin-San You, No. 3 Lane 1029, Feng-Shyn Rd., Feng Yuan City, Taichung Hsien, Taiwan

[21] Appl. No.: 913,655

[22] Filed: Jul. 16, 1992

[30] Foreign Application Priority Data

Jan. 6, 1992 [TW] Taiwan ..... 81100057

[51] Int. Cl.[5] ..... A63B 49/04

[52] U.S. Cl. ..... 29/527.4; 264/254; 273/73 R; 273/73 C; 273/73 H

[58] Field of Search ..... 29/527.4; 273/73 K, 273/73 H, 73 C, 73 R; 264/135, 254, 273, 274

[56] References Cited

U.S. PATENT DOCUMENTS

| | | | |
|---|---|---|---|
| 4,052,499 | 10/1977 | Goupil et al. | 264/254 X |
| 4,998,337 | 3/1991 | Tiekink | 29/527.4 |
| 5,054,780 | 10/1991 | Chen | 273/73 C X |
| 5,100,136 | 3/1992 | Chen | 273/73 C X |

FOREIGN PATENT DOCUMENTS

| | | | |
|---|---|---|---|
| 470364 | 12/1950 | Canada | 29/527.4 |

*Primary Examiner*—Joseph M. Gorski
*Attorney, Agent, or Firm*—Browdy and Neimark

[57] ABSTRACT

A method of making a game racket frame comprises the use of a tubular body of aluminum alloy consistent with a shape of a racket frame. An annular recess is provided respectively at the mid-point of the left-hand half of the head frame and at the mid-point of the right-hand half of the head frame. The annular recess is coated with adhesive resin. The tubular body is placed in a molding tool comprising a mold cavity having an annular ring which is located at a position corresponding to the annular recess of the tubular body and which has a shape corresponding to that of the annular recess of the tubular body and a size slightly larger than that of the annular recess of the tubular body. The molten plastic material is injected into the mold cavity under pressure and heat. Upon completion of the curing of the plastic material, the racket frame is removed from the molding tool. The racket frame so made is provided with weight-balancing pieces fastened securely to the head frame of the racket.

5 Claims, 4 Drawing Sheets

METHOD OF MAKING GAME RACKET FRAME

BACKGROUND OF THE INVENTION

The present invention relates to a method of making a racket frame, and more particularly to a method of making a racket frame made of aluminum alloy and provided with a weight-balancing system.

According to the prior art method, a racket frame, especially a tennis racket frame, is generally provided with weight-balancing pieces fastened respectively to the mid-point of the left-hand half of the head frame and to the mid-point of the right-hand half of the head frame, so as to enhance the inertia of the racket and to prevent the racket from twisting upon hitting a ball. However, it is often difficult to have such weight-balancing pieces fastened securely to a head frame of aluminum alloy.

SUMMARY OF THE INVENTION

It is, therefore, the primary objective of the present invention to provide a method of making a racket frame made of aluminum alloy and provided with weight balancing pieces, which are securely fastened to the head frame.

In keeping with the principles of the present invention, the foregoing primary objective of the present invention is accomplished by a method of making a game racket frame, which comprises a tubular body of aluminum alloy consisting with a shape of a racket frame having a head frame with an open end coupled with a shaft. An annular recess of a predetermined length is provided respectively at the mid-point of the left-hand half of the head frame and at the mid-point of the right-hand half of the head frame. The annular recess is coated with adhesive resin. The method calls for the use of a molding tool comprising a mold cavity having an annular ring, which is located at a position corresponding to the annular recess of the tubular body and which has a shape corresponding to that of the annular recess of the tubular body and a size slightly larger than that of the annular recess of the tubular body. The annular recess of the tubular body is placed in the mold cavity of the molding tool. The plastic material is then injected into the mold cavity of the molding tool under a predetermined pressure and at a predetermined temperature. Upon the completion of the curing of the injected plastic material, the racket frame is removed from the molding tool. The racket frame so made is provided with weight-balancing pieces fastened securely to the head frame of the racket.

DETAILED DESCRIPTION OF THE PREFERRED EMBODIMENTS

Figure 1:
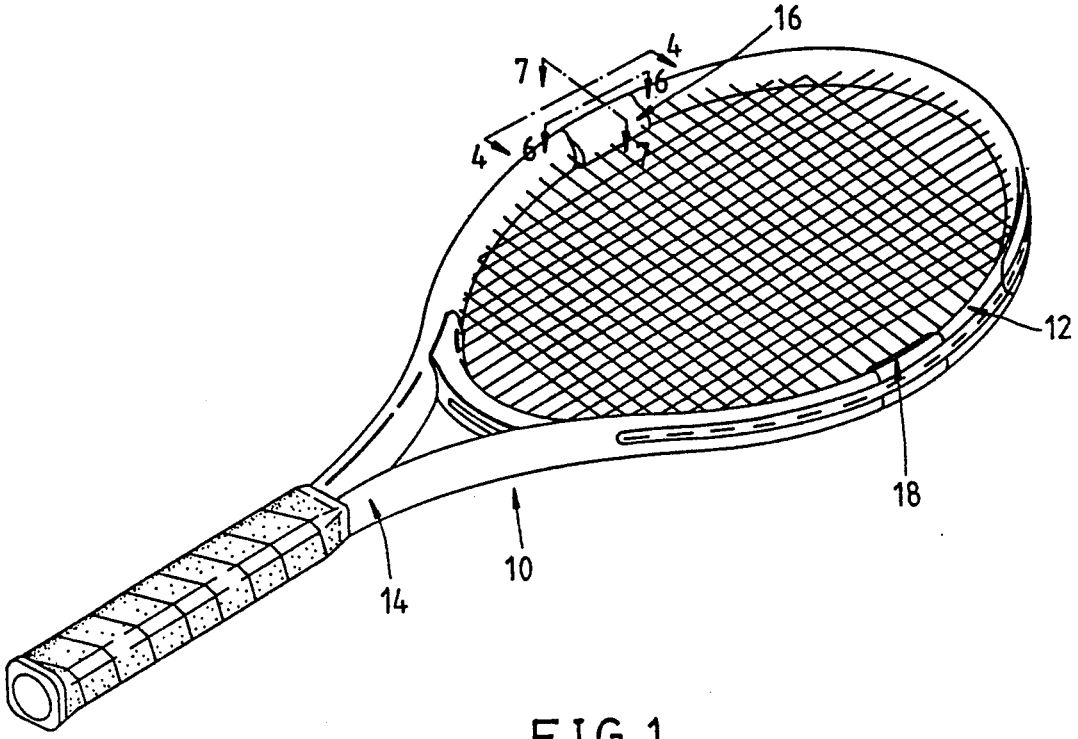
FIG. 1 shows a schematic view of a racket frame of aluminum alloy of a first preferred embodiment of the present invention.
Figure 2:
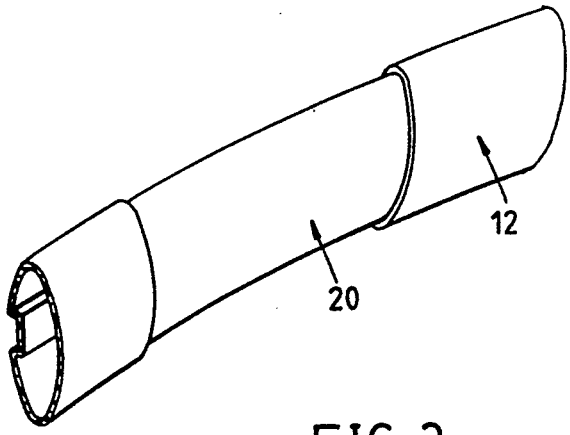
FIG. 2 shows a three-dimensional schematic view of a punched annular recess of a head frame embodied in the present invention.
Figure 3:
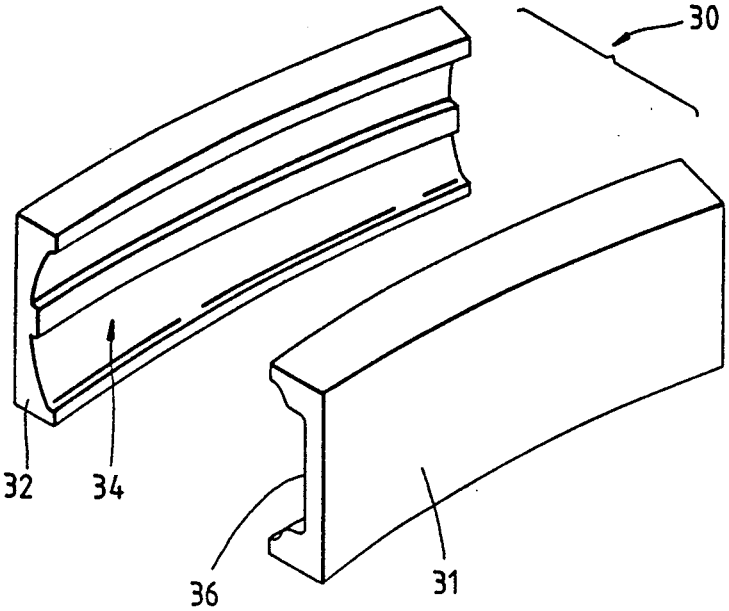
FIG. 3 shows a three-dimensional molding tool of the first preferred embodiment of the present invention.

Referring to FIGS. 1–4, a racket 10 made of aluminum alloy tubular body embodied in the present invention is shown to comprise a head frame 12 and a shaft 14. A punched annular recess 20 of a predetermined length is provided respectively at the mid-point of the left-hand half of the head frame 12 and at the mid-point of the right-hand half of the head frame 12. The annular recess 20 is coated with epoxy resin. A molding tool 30 comprises a male and a female molds 31 and 32 making up a mold cavity 34, which has a size larger than the head frame 12 and a widened portion 36 facing the inner side of the annular recess 20. The plastic material mixed with epoxy resin is injected into the mold cavity 34. Upon the completion of the curing of the injected plastic material, the racket frame 10 is removed from the molding tool 30. The racket frame 10 so made is provided with the head frame 12 having weight-balancing pieces 16 and 18, which are located respectively at the mid-point of the left-hand half of the head frame 12 and at the mid-point of the right-hand half of the head frame 12.

The weight-balancing pieces 16 and 18 are securely fastened to the head frame 12 by virtue of the facts that they are mechanically held securely to the annular recesses 20 and 22 and that they are securely adhered to the surfaces of the annular recesses 20 and 22 by means of a mixture containing the plastic material and the epoxy resin. The weights of the weight-balancing pieces 16 and 18 can be adjusted in accordance with the sizes of annular recesses 20 and 22, and of the mold cavity 34, and the weight of the injected plastic material.

Figure 5:
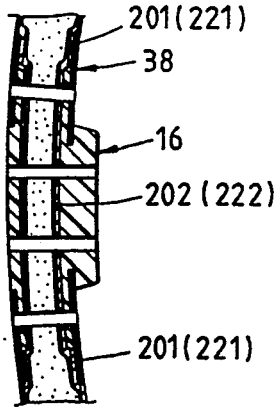
FIG. 5 shows a sectional view of a portion of a second preferred embodiment of the present invention.
Figure 6:
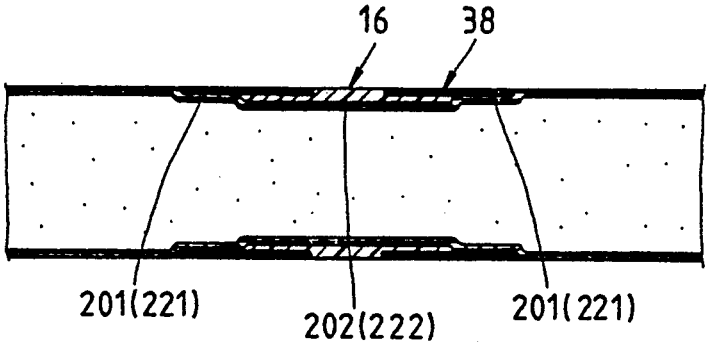
FIG. 6 shows a sectional view of a portion taken along the line 6—6 as shown in FIG. 1.

As shown in FIGS. 5 and 6, the annular recesses 20 and 22 are provided respectively with first step portions 201 and 221 and with second step portions 202 and 222 located between the first step portions 201 and 221. A bridging layer 38 made from carbon fiber fabric preimpregnated in epoxy resin is attached to the mold cavity wall located in a position corresponding to the first step portions 201 and 221. Thereafter, the annular recesses 20 and 22 are placed in the mold cavity 34, into which a molten plastic material is injected, so that the gap between the cured bridging layer 38 and the wall of the mold cavity 34 is filled in by the injected plastic material. As a result, the weight-balancing pieces 16 and 18 are securely and intimately adhered to the annular recesses 20 and 22.

Figure 7:
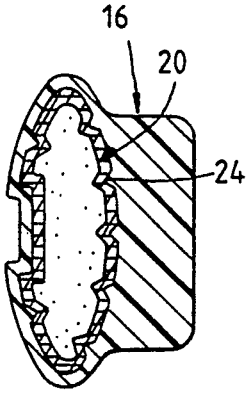
FIG. 7 shows a sectional view of a portion taken along the line 7—7 as shown in FIG. 1.
Figure 4:
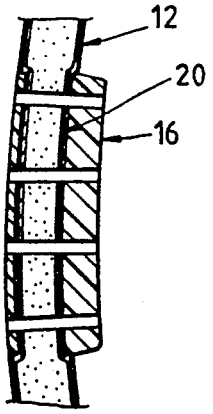
FIG. 4 shows a sectional view of a portion taken along the line 4—4 as shown in FIG. 1.
Figure 8:
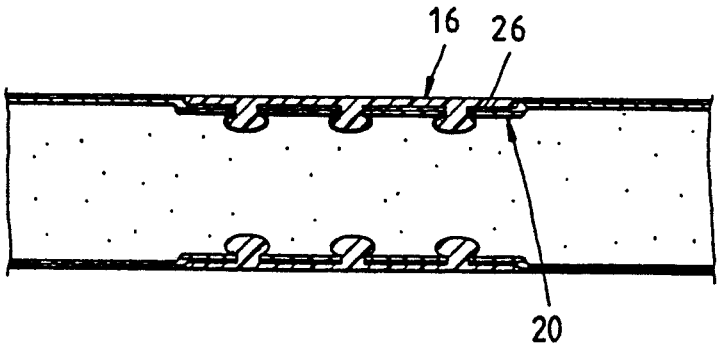
FIG. 8 shows a sectional view of a portion of a racket frame of aluminum alloy of a fourth embodiment of the present invention.

In order to ensure further that the cured plastic material in the annular recesses 20 and 22 is securely anchored, the annular recesses 20 and 22 are further provided with a plurality of cavities 24 or ducts 26, into which the injected plastic material flows and anchors, as shown in FIGS. 7 and 8.

Figure 9:
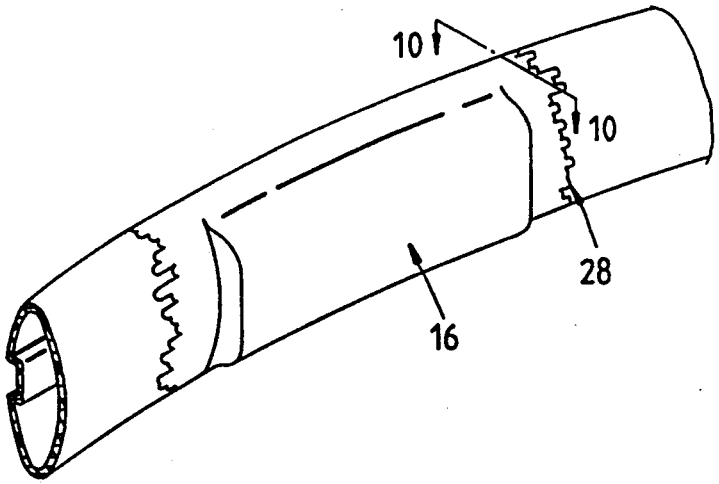
FIG. 9 shows a three-dimensional view of a racket frame of aluminum alloy of a fifth embodiment of the present invention.
Figure 10:
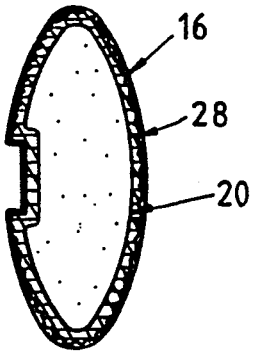
FIG. 10 shows a sectional view of a portion taken along the line 10—10 as shown in FIG. 9.
Figure 11:
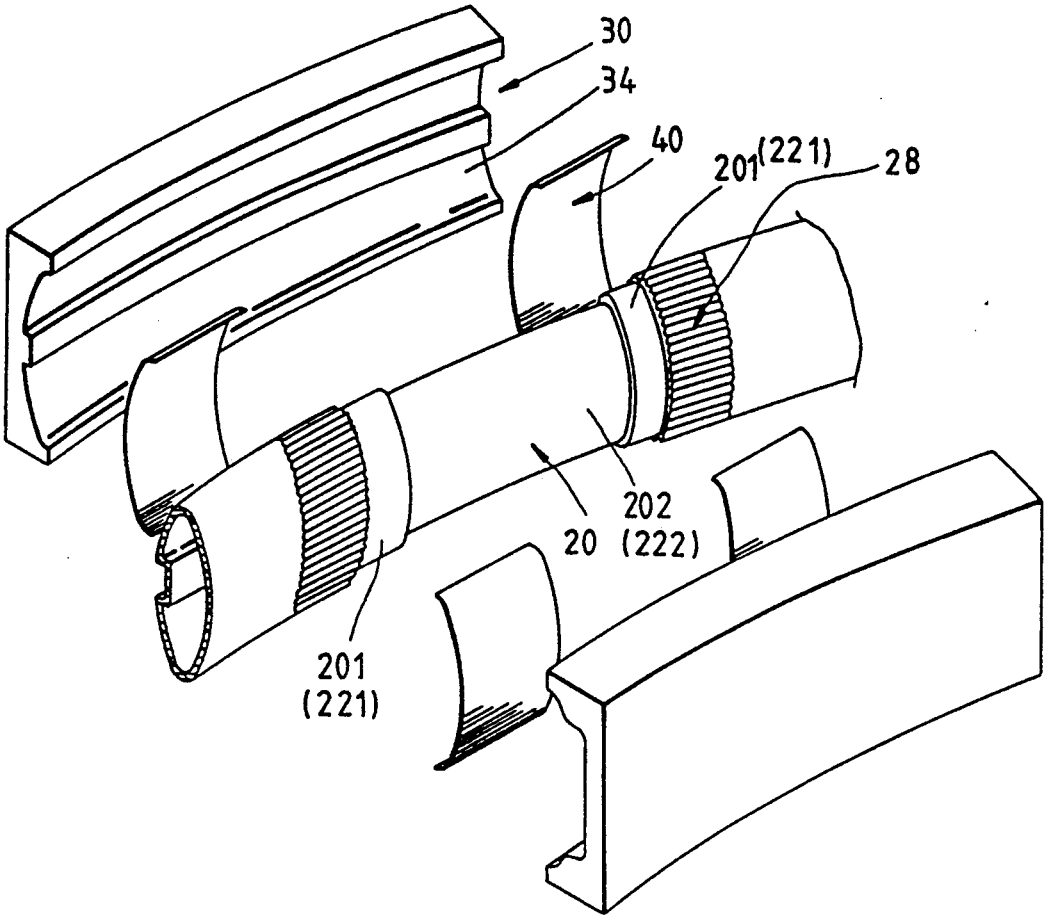
FIG. 11 shows a three-dimensional schematic view of manufacturing process of a sixth preferred embodiment of the present invention.
Figure 12:
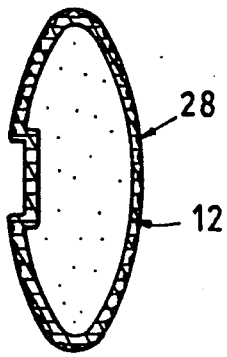
FIG. 12 shows a sectional view of a racket frame of aluminum alloy of the sixth preferred embodiment of the present invention.

In order to prevent the junction area between the weight-balancing pieces 16 and 18 and the annular recesses 20 and 22 from cracking, a plurality of serrated grooves 28 of various lengths are constructed at the junction surface between the head frame 12 and the annular recesses 20 and 22, so as to allow the injected plastic material to flow and anchor thereinto. In view of the fact that the serrated grooves 28 are of different lengths, an uneven junction line is formed in the junction between the weight-balancing pieces 16 and 18 and the head frame 12, as shown in FIGS. 9 and 10. Such structures as described above serve to avert the cracking of the junction area between the weight-balancing pieces 16 and 18 and the annular recesses 20 and 22.

Furthermore, the serrated grooves 28 of an equal length may be disposed in the annular recesses 20 and 22, which are provided respectively with the first and the second step portions 201, 221, 202 and 222. A bridging layer 40, which is made of carbon fiber fabric preimpregnated in epoxy resin, is attached to the wall of mold cavity 34 opposite to each of serrated grooves 28 and each of the first step portions 201 and 221. Such bridging layer 40 is embedded in the serrated groove 28 upon completion of the curing process thereof. As a result, the junction area between the weight-balancing pieces 16 and 18 and the head frame 12 is further reinforced.

What is claimed is:

1. A method of making game racket frame comprising the steps of:

(a) forming a tubular body of aluminum alloy into a racket frame having a head frame and a shaft extending outwardly from an open end of said head frame;

(b) forming an annular recess of a predetermined length located respectively at a mid-point of a left-hand half of said head frame and at a mid-point of a right-hand half of said head frame;

(c) providing a plurality of cavities in each said annular recess;

(d) coating each said annular recess with an adhesive resin;

(e) placing said head frame in a molding tool having a cavity provided with a widened portion facing an inner side of said annular recess and with a shape and a size slightly larger than said annular recess;

(f) injecting a molten plastic material into said cavity of said molding tool under pressure at a predetermined temperature; and (g) removing said racket frame from said molding tool upon completion of the curing of said plastic material.

2. The method of claim 1 wherein said forming of said annular recess comprises forming said annular recess with two first step portions located respectively at both ends thereof and with a second step portion located between said two first step portions.

3. The method of claim 1 wherein said forming of said annular recess comprises forming a junction surface between said head frame and said annular recess with a plurality of serrated grooves.

4. The method of claim 1 further comprising, prior to step (e), providing said cavity of said molding tool with a bridging layer made of carbon fiber fabric preimpregnated in a thermosetting resin and located at a position corresponding to said annular recess.

5. The method of claim 1 wherein providing said annular recess with a plurality of cavities comprises providing said cavities with a plurality of ducts at the time when said annular recess is formed.

* * * * *